United States Patent [19]

Diefendahl et al.

[11] 4,355,431

[45] Oct. 26, 1982

[54] BRIDGE ELEMENT

[75] Inventors: Wolfgang Diefendahl; Karl-Friedrich Koch, both of Duisburg, Fed. Rep. of Germany

[73] Assignee: Fried. Krupp Gesellschaft mit beschränkter Haftung, Essen, Fed. Rep. of Germany

[21] Appl. No.: 152,622

[22] Filed: May 23, 1980

[51] Int. Cl.[3] ..... E01D 15/14

[52] U.S. Cl. ..... 14/27; 405/218

[58] Field of Search ..... 14/27, 2.6; 405/218, 405/219, 220

[56] References Cited

U.S. PATENT DOCUMENTS

| | | | |
|---|---|---|---|
| 2,291,078 | 7/1942 | Harris | 14/27 X |
| 3,009,326 | 11/1961 | Williams | 14/27 X |
| 3,036,539 | 5/1962 | Storey | 14/27 X |
| 3,296,639 | 1/1967 | Pawlus | 14/27 |
| 3,504,389 | 4/1970 | Longbottom | 14/27 X |
| 3,691,974 | 9/1972 | Seiford | 14/27 X |
| 4,145,786 | 3/1979 | Myers | 14/27 |

*Primary Examiner*—Nile C. Byers, Jr.

*Attorney, Agent, or Firm*—Becker & Becker, Inc.

[57] ABSTRACT

A floatable bridge element for briding obstacles, especially bodies of water. Automatically latching coupling elements are provided along one longitudinal side and along both end faces in such a way that the bridge element can be widened with a further, identically or correspondingly embodied bridge element into a bridge, or with further bridge elements can be extended into a "single-track" or "dual-track" floating bridge. The bridge element includes a flat hollow compartment panel filled with foam and simultaneously serving as a roadway, and below which extends a buoyancy body likewise filled with foam and rigidly connected therewith. The buoyancy body, for reducing the impact pressure in flowing waters, is inclined or angled-off along the lower edge of that longitudinal side of the bridge element not provided with coupling elements. Along the same longitudinal side, an elevated hollow web member is preferably arranged which is likewise filled with foam and angled-off underneath; this hollow web member besides providing a reinforcement of the bridge element, makes possible a separation of a walkway from the roadway and the avoidance of overflow.

8 Claims, 12 Drawing Figures

A
VII
VII
1
2
3
4
5
6
7
8
9
10
11
12
13

BRIDGE ELEMENT

The present invention relates to a floatable bridge element, having a roadway and being inclined at the lower edge along one longitudinal side, for bridging obstacles, especially bodies of water. The bridge element comprises a hollow compartment panel element with coupling devices for connection with other bridge elements, the underside of the hollow compartment panel element having arranged thereon a lift or buoyancy body.

The known elements for floatable bridges capable of being assembled in most instances must first be made floatable by the addition of lift or buoyancy bodies, a procedure which in spite of the utilization of parts fitting each other and quickly connectible with each other still makes the assembly considerably more difficult.

Such an elongated structural element having a U- or C-cross section, and disclosed by German Auslegeschrift No. 11 27 933, respectively has hollow compartment plates as web and flange means. In the space between the web, which is arranged horizontally and on top, and the flanges, there is provided an inserted, inflatable hose. Every structural element, at the four upper corners thereof, has a coupling device which makes it possible to connect two, three or four structural elements provided respectively with the same coupling devices at these corners for joinder to each other. However, a special coupling plate as well as an adjustment tool are needed respectively to effect this connection. Since additionally the construction of a bridge having full roadway width requires a series of structural elements to be placed adjacent each other, the assembly, even with relatively small bridges, is still rather expensive and time-consuming.

The basic object of the present invention is to create a bridge element of the aforementioned general type which has a versatile use and additionally makes possible a quick and simple assembly into a bridge.

This object, and other objects and advantages of the present invention, will appear more clearly from the following specification in connection with the accompanying drawings, in which.

Figure 2:
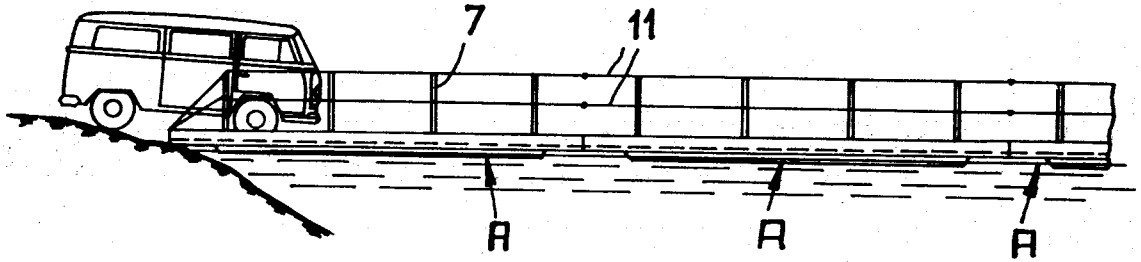
FIG. 2 is a side view of a full-track bridge.
Figure 1:
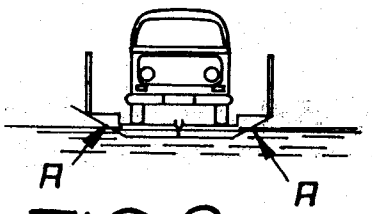
FIG. 1 illustrates schematically a front view of a full-track ferry comprising at least two bridge elements coupled with respect to each other.
Figure 3:
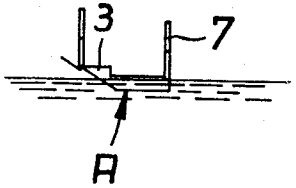
FIG. 3 is a front view of an individual floating bridge element used as a ferry.

In the present invention, the literal term "web" shall have the meaning of path, stage, or preferably bridge. This bridge element is characterized primarily in that the rigid buoyancy body is inclined or angled-off, and extends below, and is rigidly connected with, the flat compartment panel, which serves as a roadway. The bridge element is further characterized in that as coupling devices, along the longitudinal side which is not angled-off, as well as along both end faces, respectively at least one coupling element is arranged which fits a corresponding coupling element arranged on another bridge element and, during connection, latches therein; furthermore, the coupling elements are so arranged that at least during end face connection of two bridge elements, the latter are in alignment with each other.

The bridge element, along its slanted or angled-off longitudinal side, may be provided with an elevated hollow web member, of which that underside which adjoins the incline rises outwardly. Foldable guard rails may be provided along the longitudinal sides of the bridge element. The inclined longitudinal side of the bridge element may be provided with a baffle which is preferably subdivided in the longitudinal direction, and is capable of being unfolded or extended upwardly at an incline from the underside of the bridge element. The hollow compartment panel, the bridge, and the buoyancy body may be filled with foam of a suitable light material, such as polyurethane or the like.

The coupling elements may be automatically latchable with the counter coupling elements. The bridge element, in the region of the upper longitudinal edges thereof, may be provided with a projecting profile part limited at its top with a bead; the profile part has bores for journalling the rail supports and handle openings.

The novel bridge element has the advantage that it is suitable individually or coupled with further bridge elements for a series of differing functions. As an individual bridge element or widened by a further element coupled thereto it can be used as a non-floating bridge. Furthermore, such a bridge element, if necessary suitably lengthened by further bridge elements, can also be used as a floating ferry or ferryboat. The bridge, to be used for bridging bodies of water, bogs or swamps, and also a slightly hilly terrain or similar obstacles, can be embodied in a "half-track" manner by sequentially connected individual bridge elements, and can also be embodied in a "full-track" manner by bridge elements sequentially connected in pairs. Preferably, the half-track embodiment is intended for pedestrians and, if necessary, bicycles, and the full-track embodiment is intended for motor vehicles.

Referring now to the drawings in detail, the following description refers more closely to the drawing illustrations, including an embodiment of the bridge element according to the present invention as well as different possibilities of use and installation thereof.

Figures 6, 7:
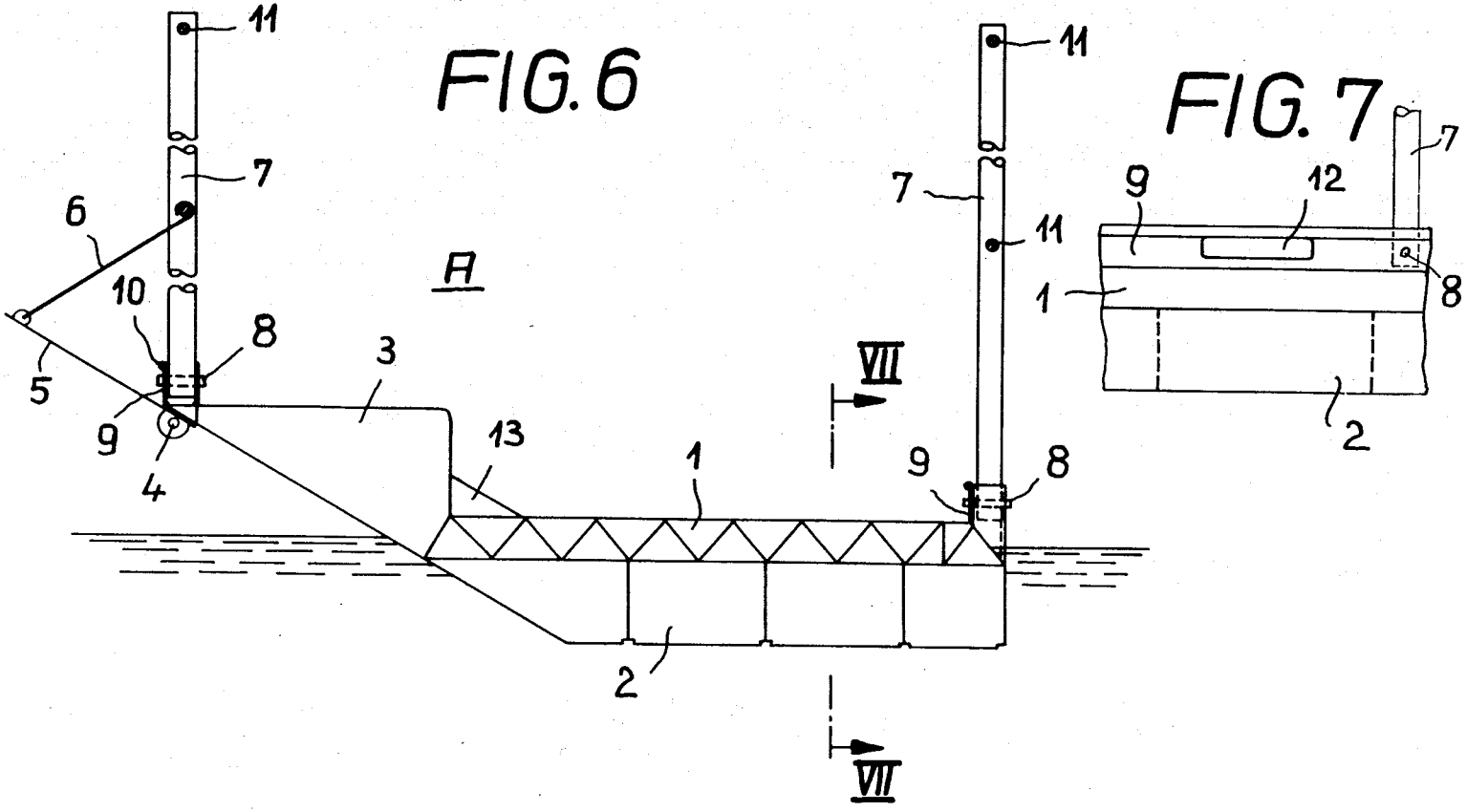
FIG. 6 is a cross sectional view of a bridge element as a part of a half-track floating bridge.
FIG. 7 is a section taken along line VII—VII in FIG. 6 in a fragmentary view.

As apparent from FIG. 6, the bridge element A has a hollow compartment panel 1 serving as a roadway, and along the underside of which is arranged a lift or buoyancy body 2 which is subdivided into several chambers. A hollow web member 3 is so arranged along one longitudinal side of the hollow compartment panel 1 that the upper panel portion thereof extends approximately horizontally and is embodied as a walkway, while the lower panel portion thereof is so arranged that it rises from the inside to the outside. The same incline is provided by that part of the lift or buoyancy body 2 which adjoins the hollow web 3. This inclined portion prevents water from washing or flowing over the walkway or the roadway, and, with quickly flowing waters, reduces the impact pressure on the bridge element, so that, with half-track bridges, this inclined portion is so to be arranged that it faces the flow direction of the water.

At the outer end of the hollow web 3 is arranged a multisectional baffle 5 which is pivotal about joints or hinged bearings 4 and, in its folded-out condition, has the same inclination as the underside of the hollow web 3; the baffle 5 is capable of being fastened by rods 6 on a suitable part of the struts or supports 7 of a a guardrail. At their lower ends, the supports 7 are pivotally secured to a profile member 9 by means of bolts 8. This profile member 9 is arranged along the outer longitudinal edge of the hollow web member 3 and has a bead 10 along the upwardly projecting upper side thereof. An identical profile member 9 is arranged along the other longitudinal edge of the bridge element A and serves in this location likewise, among other things, for holding guardrail supports 7. Ropes or cables 11 are fastened as transverse or diagonal trussing between the individual guardrail supports. These ropes or cables 11 are located at the upper outer end and approximately in the middle of the supports 7. The profile members 9 furthermore are provided with openings 12 therethrough for carrying them by hand. These openings are distributed over the length of the profile members and are located in the vicinity of the end faces of the bridge element A; these openings 12 can also be used, when required, for fastening any assembly aids, including for instance ropes or cables.

The hollow compartment plate 1, the hollow web member 3, and the lift or buoyancy body 2 are foamed-out or filled with a suitable known light-weight material, whereby the bridge element is made unsinkable and additionally is made more resistant against deformation. Additionally, a stiffening web portion 13 is provided between the hollow compartment plate 1 and the hollow web member 3. The hollow compartment plate 1, the hollow web member 3, and the lift or buoyancy body 2 comprise a suitable aluminum construction material to keep the weight of the bridge elements low and to simultaneously obtain a corrosion protection. However, also other, especially metallic, materials can be used for these parts if required.

Figure 8:
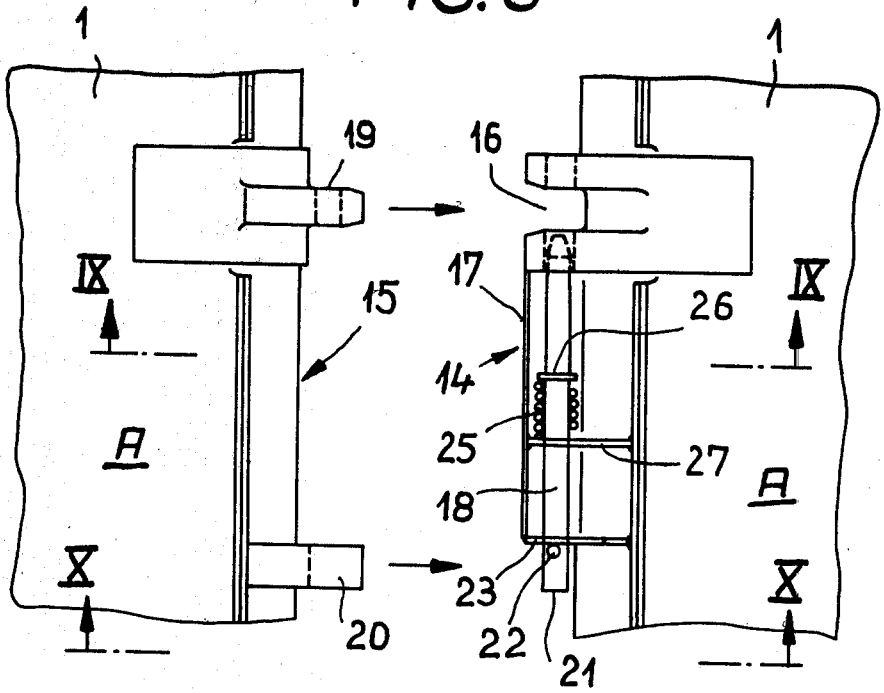
FIG. 8 is a plan view, prior to coupling, of the coupling elements of two spaced apart bridge elements.
Figure 9:
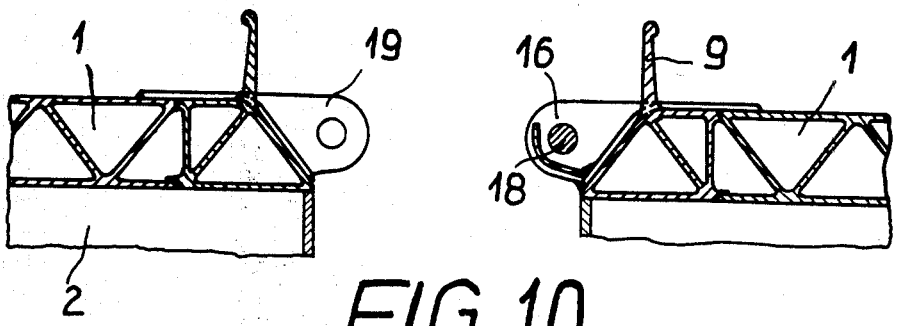
FIG. 9 is a section taken along line IX—IX in FIG. 8.
Figure 10:
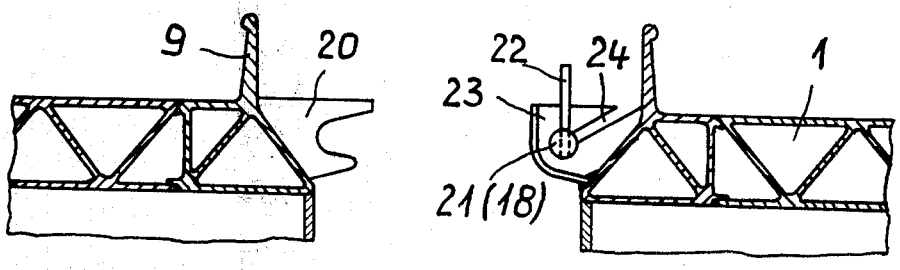
FIG. 10 is a section taken along line X—X in FIG. 8.
Figure 11:
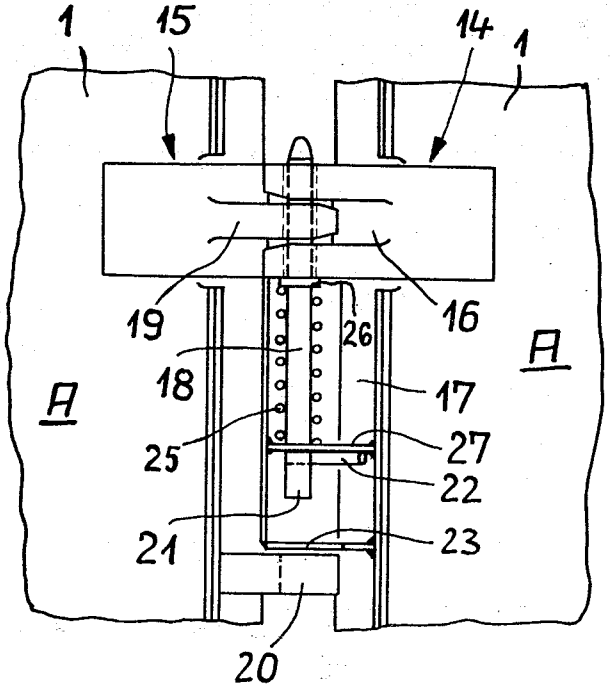
FIG. 11 illustrates the parts shown in FIG. 8 in a corresponding representation after the coupling procedure.

The coupling illustrated in FIG. 8 comprises the attachment or coupling sections 14 and 15 which are respectively arranged opposite each other along the longitudinal sides of the bridge element A, which have no hollow web member 3, in such a way that each bridge element in this location has a coupling section 14 and a coupling section 15, respectively. The coupling section 14 comprises a double eye 16 and a bolt 18 journalled in a guide 17. The coupling section 15 encompasses one eye 19, which is introducible into the double eye 16, as well as a fork 20 which, during the coupling process, grasps around the oppositely located end 21 of the bolt 18 projecting from the guide 17. During this operation, an upwardly extending pin 22 fastened in the end 21 is then pivoted about the axis of the bolt 18 by the upper nose of the fork 20 to such an extent that it is located across the slot 24 provided in the face wall 23 of the guide 17 (FIG. 10). Hereby the bolt 18, up to now held by the pin 22 and a spring 25 in its position, is released by the spring 25, and the eye 19 latches with the double eye 16, as recognizable from FIG. 11. The spring 25, which is a pressure-spiral spring, is slipped over the bolt 18, and with one end abuts against a collar or flange 26 of the bolt 18, and with its other end abuts against a further transverse wall 27 of the guide 17. After the coupling procedure, the flange 26 engages the double eye 16. Identical coupling sections are arranged along the face sides of the bridge element A in such a manner that one face side, and in particular always the same, has a coupling section 14 and the other face side has a coupling section 15. In this manner, every bridge element is usable at every location in any combination of bridge elements. With a full-track coupling of the bridge elements, they are located in pairs across each other. A displaced opposite location of the bridge elements is likewise possible, though for this purpose a different arrangement of the coupling sections is necessary.

Figure 4:
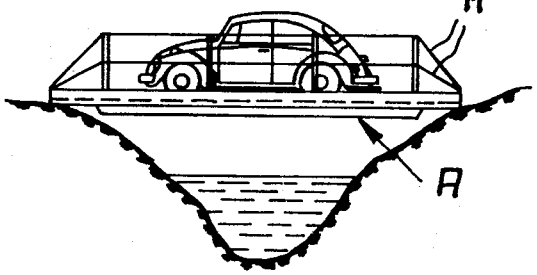
FIG. 4 is a side view of a full-track short bridge assembled using two bridge elements.
Figure 5:
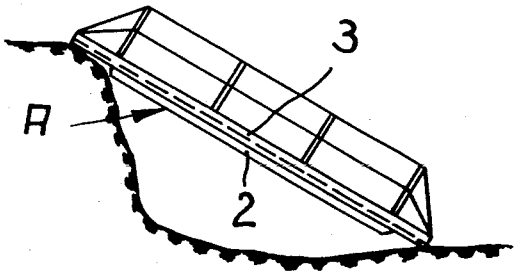
FIG. 5 is a side view of a single bridge element used to form a steeply rising short bridge.
Figure 12:
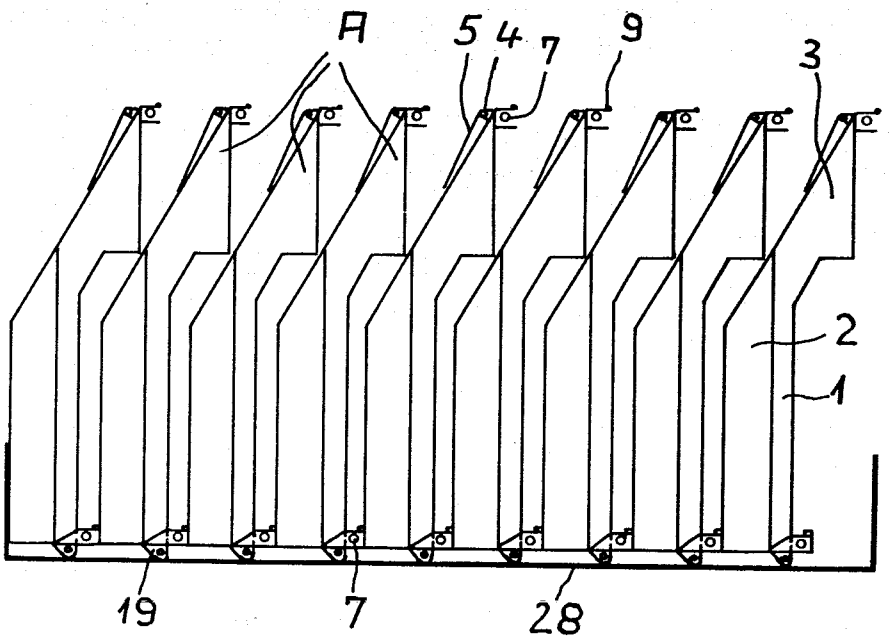
FIG. 12 is a front view of several nested or stacked bridge elements for transporting thereof with a vehicle.

As shown in FIG. 12, due to the expedient cross sectional configuration of the bridge elements A, transporting space is saved when transporting several bridge elements by stacking or nesting them. For this purpose, the bridge elements are expediently arranged or placed upright or on edge upon the transporting means, for instance a plank bed or platform 28 of a truck. For transporting purposes, the baffles 5 are folded inwardly and the supports or struts 7 of the guardrail are so folded that they essentially lie parallel to the profile members 9, as indicated respectively in FIG. 12. The ropes or cables 11 are so dimensioned and arranged that they permit such placement. The open ends of the end faces of the bridge element are capable of being hooked or secured along these end faces for holding or tensioning the guardrail when the bridge elements are utilized as short bridges or individual webs as shown in FIG. 4 or 5. In case the bridge elements are placed in rows following one another, the rope or cable ends are respectively connected with each other by the same hook parts, as shown in FIG. 2. The coupling formed by the coupling sections 14 and 15 provide a sufficient play to avoid possible forcing together of the parts and to facilitate the coupling procedure.

The present invention is, of course, in no way restricted to the specific disclosure of the specification and drawings, but also encompasses any modifications within the scope of the appended claims.

What I claim is:

1. A floatable bridge element, having a roadway and being inclined at the lower edge along one longitudinal side, for bridging obstacles, especially bodies of water, said bridge element comprising in combination:

a substantially flat hollow compartment panel, the upper surface of which serves as said roadway;

a rigid buoyancy body extending below and rigidly connected with the lower surface of said compartment panel, a portion of the underside of said buoyancy body being inclined; and coupling means, connected to said compartment panel along the non-inclined longitudinal side of said bridge element as well as along both end faces, for interconnecting bridge elements along their non-inclined longitudinal sides as well as along their end faces, said coupling means including at least one coupling section, which conforms to a coupling section of another bridge element and is adapted to latch same during interconnection of the pertaining bridge elements, said coupling means being arranged in such a way that at least during end face interconnection of two bridge elements, the latter are in alignment with each other.

2. A bridge element in combination according to claim 1, which includes an elevated hollow web member connected to said compartment panel along the inclined longitudinal side of said bridge element, that underside of said hollow member which adjoins said inclined longitudinal side rising outwardly.

3. A bridge element in combination according to claim 2, which includes foldable guardrail means located along longitudinal sides thereof.

4. A bridge element in combination according to claim 3, in which the inclined longitudinal side thereof is provided with a baffle which is unfoldable or extensible upwardly at an incline from the underside of said bridge element.

5. A bridge element in combination according to claim 4, in which said baffle is subdivided in the longitudinal direction.

6. A bridge element in combination according to claim 2, in which said compartment panel, said buoyancy body, and said hollow web member are filled with foam of a suitable light material.

7. A bridge element in combination according to claim 1, in which conforming coupling sections of pertaining bridge elements are automatically latchable with one another.

8. A bridge element in combination according to claim 3, which, in the region of its upper longitudinal edges, is provided with a projecting profile part limited near its outer extremity with a bead and having handle openings and bores for supporting said guardrail means therewith.

* * * * *

UNITED STATES PATENT AND TRADEMARK OFFICE

CERTIFICATE OF CORRECTION

PATENT NO. : 4,355,431

DATED : October 26, 1982

INVENTOR(S) : Wolfgang Diefendahl et al

It is certified that error appears in the above—identified patent and that said Letters Patent is hereby corrected as shown below:

On the title page, the following should be added:

(30) Foreign Application Priority Data

May 25, 1979 (DE) Fed. Rep. of Germany....2921180

Signed and Sealed this

Twenty-second Day of March 1983

[SEAL]

Attest:

GERALD J. MOSSINGHOFF

Attesting Officer

Commissioner of Patents and Trademarks